US010314370B2

(12) United States Patent
Brandt et al.

(10) Patent No.: US 10,314,370 B2
(45) Date of Patent: Jun. 11, 2019

(54) CLASP

(71) Applicant: NIKE, Inc., Beaverton, OR (US)

(72) Inventors: Baron C. Brandt, Portland, OR (US); Kevin C. Sze, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 15/686,451

(22) Filed: Aug. 25, 2017

(65) Prior Publication Data

US 2018/0055154 A1 Mar. 1, 2018

Related U.S. Application Data

(60) Provisional application No. 62/379,975, filed on Aug. 26, 2016.

(51) Int. Cl.

| | |
|---|---|
| ***A44B 11/25*** | (2006.01) |
| ***A41F 1/00*** | (2006.01) |
| ***A44B 13/00*** | (2006.01) |

(52) U.S. Cl.

CPC ..... *A44B 13/00* (2013.01); *A41F 1/006* (2013.01); *A44B 11/2588* (2013.01); *A44D 2200/12* (2013.01); *Y10T 24/4599* (2015.01); *Y10T 24/45984* (2015.01)

(58) Field of Classification Search

CPC ..... Y10T 24/45225; Y10T 24/45241; Y10T 24/45984; Y10T 24/47; Y10T 24/4745; Y10T 24/4522; Y10T 24/45204; Y10T 24/45209; Y10T 24/4523; Y10T 24/45267; Y10T 24/4599; Y10T 24/45995; A44B 11/258; A44B 11/2588; A44B 11/2584; A41F 1/006; A44C 5/2057

See application file for complete search history.

(56) References Cited

U.S. PATENT DOCUMENTS

| | | | | |
|---|---|---|---|---|
| 1,265,869 A | | 5/1918 | Arkin | |
| 1,555,764 A | * | 9/1925 | Slote | A44B 11/2588 24/614 |
| 1,851,730 A | * | 3/1932 | Rutherford | A41F 1/00 24/313 |

(Continued)

FOREIGN PATENT DOCUMENTS

| | | |
|---|---|---|
| AT | 354382 B | 1/1980 |
| CH | 293009 A | 8/1953 |
| GB | 796663 A | 6/1958 |

OTHER PUBLICATIONS

International Search Report and Written Opinion dated Nov. 2, 2017 in International Patent Application No. PCT/US2017/048630, 16 pages.

(Continued)

*Primary Examiner* — Robert Sandy
*Assistant Examiner* — Michael S Lee
(74) *Attorney, Agent, or Firm* — Shook, Hardy & Bacon L.L.P.

(57) ABSTRACT

A clasp includes a hook component and a catch component, which may be used to releasably attach two ends of an article. Among other elements, the hook component may include a stem (for manually operating the clasp) and a cantilevered lip suspended above the stem to form a slot for receiving a part of the catch component. In addition, the catch component may include a slot-engaging portion that is coupled between the stem and the cantilevered lip.

20 Claims, 6 Drawing Sheets

(56) References Cited

U.S. PATENT DOCUMENTS

| | | | | | |
|---|---|---|---|---|---|
| 2,016,041 | A | | 10/1935 | Koopetz | |
| 2,765,471 | A | * | 10/1956 | Cousins | A41C 3/00 24/702 |
| 3,052,005 | A | | 9/1962 | Wilson et al. | |
| 3,445,901 | A | * | 5/1969 | Kamper | A41F 1/00 24/618 |
| 3,520,033 | A | | 7/1970 | Usuda | |
| 3,837,049 | A | * | 9/1974 | Corrado | A41F 1/006 24/578.1 |
| 3,990,113 | A | | 11/1976 | Coenen | |
| 4,000,544 | A | | 1/1977 | Fildan | |
| 4,369,552 | A | | 1/1983 | Gottlieb | |
| 5,377,394 | A | | 1/1995 | Fildan | |
| 5,485,658 | A | * | 1/1996 | Fildan | A41F 1/006 24/614 |
| 6,330,736 | B1 | | 12/2001 | Cheng | |
| 6,360,404 | B1 | | 3/2002 | Mudge et al. | |
| 6,598,272 | B2 | | 7/2003 | Nire | |
| 7,506,419 | B2 | * | 3/2009 | Kung | A44B 11/2573 24/303 |
| 7,624,484 | B2 | | 12/2009 | Lundh | |
| 8,726,850 | B2 | | 5/2014 | Rosenquist et al. | |
| 9,101,185 | B1 | | 8/2015 | Greenberg | |
| 9,113,678 | B2 | | 8/2015 | Leung | |
| 2004/0139586 | A1 | * | 7/2004 | Fox | A44C 5/2042 24/701 |
| 2014/0053380 | A1 | * | 2/2014 | Leung | A44B 11/258 24/633 |
| 2014/0150222 | A1 | * | 6/2014 | Sautter | B60P 7/135 24/69 CT |
| 2017/0164671 | A1 | * | 6/2017 | Fildan | A44B 17/0023 |

OTHER PUBLICATIONS

International Preliminary Report on Patentability dated Mar. 7, 2019 in International Patent Application No. PCT/US2017/048630, 9 pages.

* cited by examiner

CLASP

CROSS-REFERENCE TO RELATED APPLICATIONS

This non-provisional application claims the benefit of U.S. Provisional Patent Application No. 62/379,975 (filed Aug. 26, 2016), which is incorporated herein by reference in its entirety.

TECHNICAL FIELD

This disclosure relates to a clasp for releasably affixing two articles together, such as two straps or two opposing ends of a strap.

BACKGROUND

Releasable clasps are often used to attach straps together when adjusting a size or shape of a garment or other article (e.g., bra, waistband, belt, adjustable headwear, footwear bags, and the like). Some clasps can be more difficult to connect or release, especially when the connection is performed "blindly," such as behind a person's back. In addition, some clasps may include a thicker profile and/or be more rigid, which can affect the comfort of the clasp against a wearer's body.

BRIEF DESCRIPTION OF THE DRAWINGS

The present invention is described in detail herein with reference to the attached figures, which are incorporated herein by reference, wherein.

DETAILED DESCRIPTION

Figure 1:
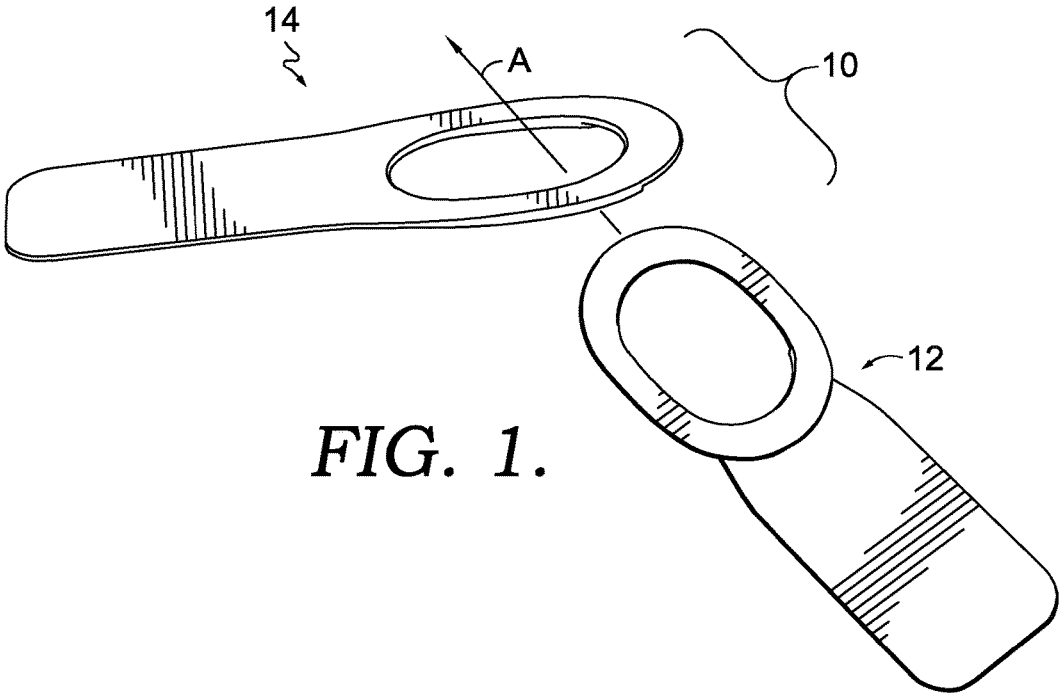
FIGS. 1-3 depict various positions of a hook component and a catch component when a clasp is being operated, in accordance with an aspect hereof.

Subject matter is described throughout this Specification in detail and with specificity in order to meet statutory requirements. But the aspects described throughout this Specification are intended to be illustrative rather than restrictive, and the description itself is not intended necessarily to limit the scope of the claims. Rather, the claimed subject matter might be practiced in other ways to include different elements or combinations of elements that are similar to the ones described in this Specification and that are in conjunction with other present, or future, technologies. Upon reading the present disclosure, alternative aspects may become apparent to ordinary skilled artisans that practice in areas relevant to the described aspects, without departing from the scope of this disclosure. It will be understood that certain features and subcombinations are of utility and may be employed without reference to other features and subcombinations. This is contemplated by, and is within the scope of, the claims.

Overview of Exemplary Aspects of a Clasp

At a high level, the disclosure describes a clasp that connects two articles together, and in one aspect, the clasp includes one or more features that render the clasp usable with a garment (e.g., bra straps, belt, and other adjustable garments). Among other possible elements, the clasp may include structural features that provide a relatively low profile, which is sometimes desirable when worn against, or close to, a wearer's body. In addition, the clasp may be flexible, and less rigid (relative to other mechanisms), which can contribute to a more comfortable fit. Further, the clasp may include components that interlock in a relatively intuitive manner, which may facilitate "blind" connection, such as behind a wearer's back. These and other features will be described in more detail in other portions of this disclosure.

In one aspect of the disclosure, the clasp generally includes a hook component and a catch component that releasably mate with one another in an interlocking configuration. The hook component includes a hook-component stem that is attachable to a first article (e.g., first strap). In addition, a neck extends from the hook-component stem and is attached to a cantilevered lip. The neck suspends the cantilevered lip apart from the hook-component stem to form a catch-receiving slot between the cantilevered lip and the hook-component stem.

In a further aspect, the catch component includes a catch-component stem that is attachable to a second article (e.g., second strap or opposing end of the first strap to which the hook-component stem is attachable). In addition, the catch component includes a hook-engaging portion coupled to the catch-component stem. The hook-engaging portion forms an eyelet through which the cantilevered lip is inserted when the hook component is mated with the catch component to achieve the interlocking configuration. Further, the hook-engaging portion includes a lip-facing surface that faces towards the cantilevered lip in the interlocking configuration and includes a stem-facing surface that faces towards the hook-component stem in the interlocking configuration. The hook-engaging portion also includes a plate body between the lip-facing surface and the base-facing surface and includes a groove constructed into the stem-facing surface. The groove extends into the plate body and towards the lip-facing surface, and at least a portion of the hook-component stem is nested in the groove in the interlocking configuration. Furthermore, the plate body includes a slot-engaging tongue between the groove and the lip-facing surface, the slot-engaging tongue being thinner than other portions of the plate body and mating in the catch-receiving slot in the interlocking configuration.

Another aspect of the disclosure includes an article with a first strap and a second strap. The first strap includes a first-strap terminating end coupled to a hook component (such as the hook component described above), and the second strap includes a second-strap terminating end coupled to a catch component (such as the catch component described above). The catch component releasably mates with the hook component in an interlocking configuration to couple the first strap to the second strap. The hook component includes a hook-component stem coupled to the first-strap terminating end, a neck extending from the hook-component stem, and a cantilevered lip that is coupled to the neck and that overhangs the hook-component stem. The neck suspends the cantilevered lip apart from the hook-component stem to form a catch-receiving slot between the cantilevered lip and the hook-component stem. Furthermore, the catch component includes a catch-component stem, which is coupled to the second-strap terminating end, and a hook-engaging portion coupled to the catch-component stem. The hook-engaging portion at least partially forms an eyelet configured to receive the cantilevered lip when the hook component is mated with the catch component to achieve the interlocking configuration. The hook-engaging portion includes a lip-facing surface that faces towards the cantilevered lip in the interlocking configuration and includes a stem-facing surface that faces towards the hook-component stem in the interlocking configuration. The hook-engaging portion includes a plate body between the lip-facing surface and the base-facing surface and includes a groove constructed into the stem-facing surface. The groove extends into the plate body and towards the lip-facing surface, and at least a portion of the hook-component stem is nested in the groove in the interlocking configuration. Further, the plate body includes a slot-engaging tongue between the groove and the lip-facing surface, the slot-engaging tongue being thinner than other portions of the plate body and mating in the catch-receiving slot in the interlocking configuration.

In addition, an aspect of the present disclosure includes a clasp for joining two articles, the clasp including a hook component that mates with a catch component in an interlocking configuration. The hook component includes a hook-component stem configured to be coupled to a first article, a neck extending from the hook-component stem, and a cantilevered lip that is coupled to the neck and that overhangs the hook-component stem. The neck suspends the cantilevered lip apart from the hook-component stem to form a catch-receiving slot between the cantilevered lip and the hook-component stem. In addition, the neck includes a wall height that at least partially determines a dimension of the catch-receiving slot. The catch component includes a catch-component stem configured to be coupled to a second article and a hook-engaging portion coupled to the catch-component stem, the hook-engaging portion at least partially forming an eyelet configured to receive the cantilevered lip when the hook component is mated with the catch component to achieve the interlocking configuration. Further, the hook-engaging portion includes a lip-facing surface that faces towards the cantilevered lip in the interlocking configuration and a stem-facing surface that faces towards the hook-component stem in the interlocking configuration. In addition, the hook-engaging portion includes a plate body between the lip-facing surface and the stem-facing surface. The plate body includes a slot-engaging tongue that mates in the catch-receiving slot in the interlocking configuration and that includes a plate thickness that corresponds with the wall height of the neck.

Figure 2:
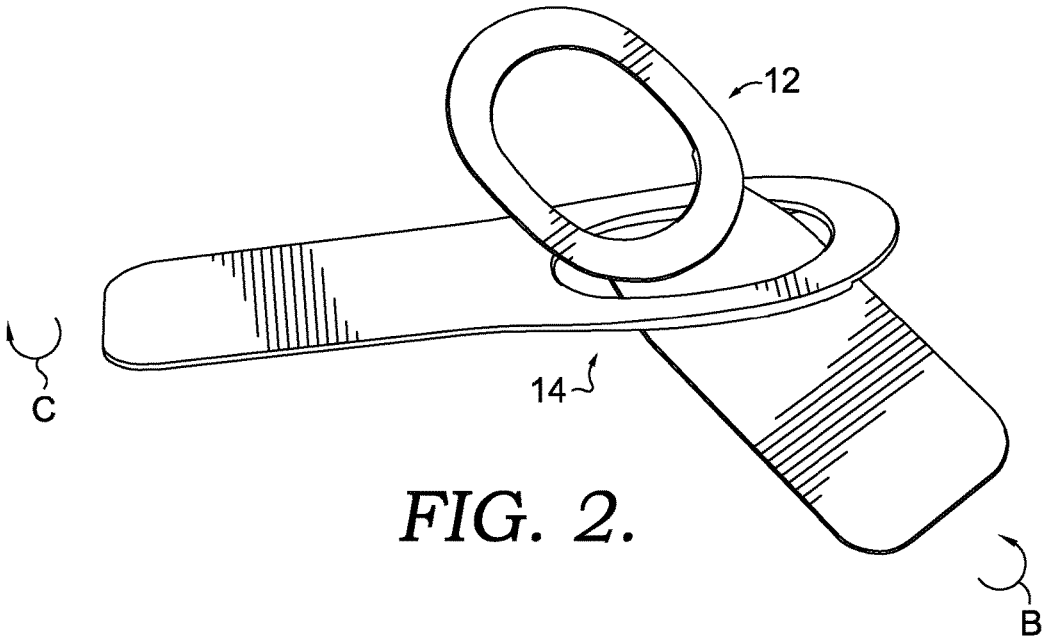
Figure 3:
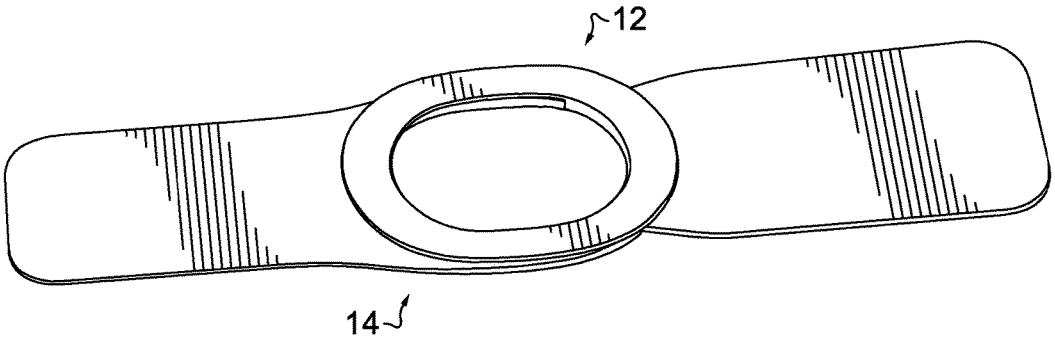
Figure 16:
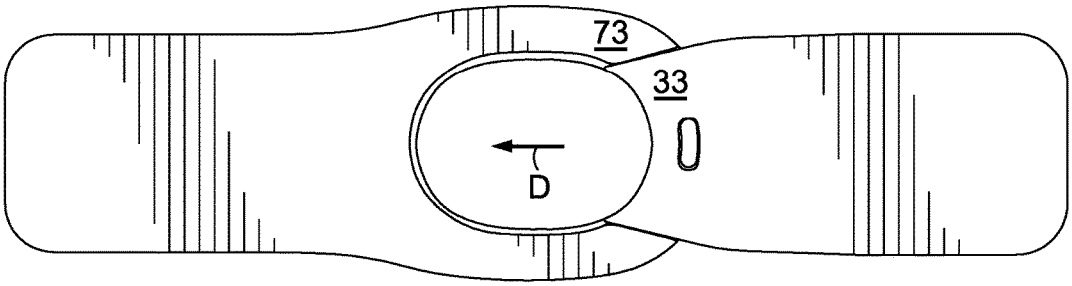
FIG. 16 depicts a bottom view of a clasp in accordance with an aspect hereof.

Having described a few different aspects of the disclosure, reference will now be made to the some of the figures to describe one manner in which an exemplary clasp might operate. Referring initially to FIGS. 1-3, an exemplary clasp 10 is depicted having a hook component 12 and a catch component 14, and each of FIGS. 1-3 depicts a different position of the hook component 12 relative to the catch component 14 in the operation of the clasp 10. For example, FIG. 1 depicts an aspect illustrating that a portion of the hook component 12 is inserted (in the direction indicated by the arrow A) through an eyelet of the catch component 14. FIG. 2 depicts another aspect in which a portion of the hook component 12 has been inserted through the eyelet of the catch component 14. The positioning depicted in FIG. 2 might occur sequentially after the positioning depicted in FIG. 1 when the components are being mated and might occur sequentially before when the components are being decoupled. In order to mate the hook component 12 and the catch component 14 in an interlocking relationship, at least one of the parts is rotated in order to align the parts. For example, the hook component 12 could be rotated in the direction of the arrow B and/or the catch component 14 could be rotated in the direction of the arrow C. Once the parts are aligned, the hook component 12 and the catch component 14 are pulled in opposite directions to achieve an interlocking configuration, as illustratively depicted in FIG. 3. While FIG. 3 depicts one side of the clasp when coupled, FIG. 16 depicts the opposing side.

Various features of the hook component 12 and the catch component 14 contribute to retaining the clasp 10 in the interlocking configuration, as will be described in further detail below. In addition, although FIGS. 1-3 depict one exemplary hook component and one exemplary catch component, the principles of operation that are described with respect to FIGS. 1-3 may apply to alternative hook components and alternative catch components (such as those described in other parts of this disclosure).

Various Exemplary Hook Components

Figure 4:
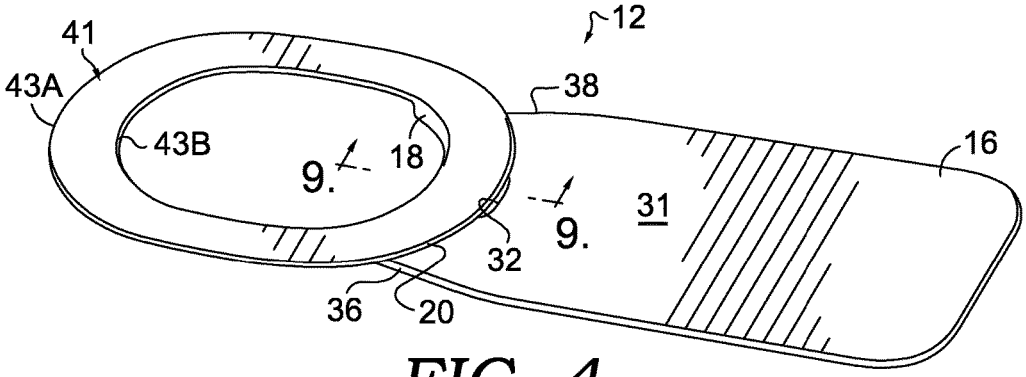
FIGS. 4-7, 8A, and 9 depict various aspects of a hook component, in accordance with an aspect hereof.
Figure 5:
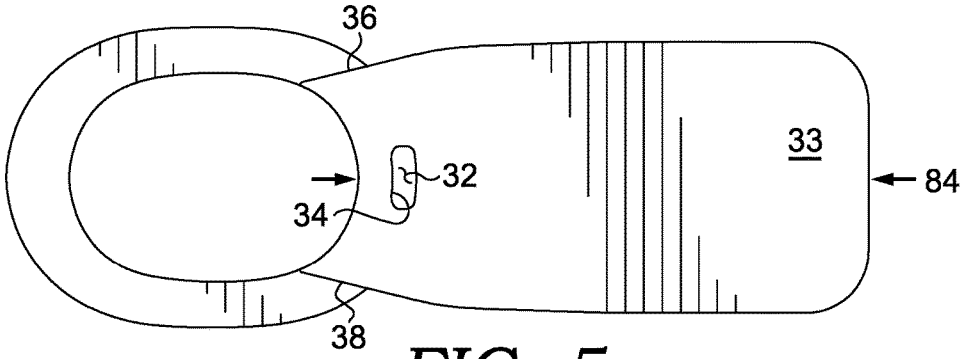
Figure 6:
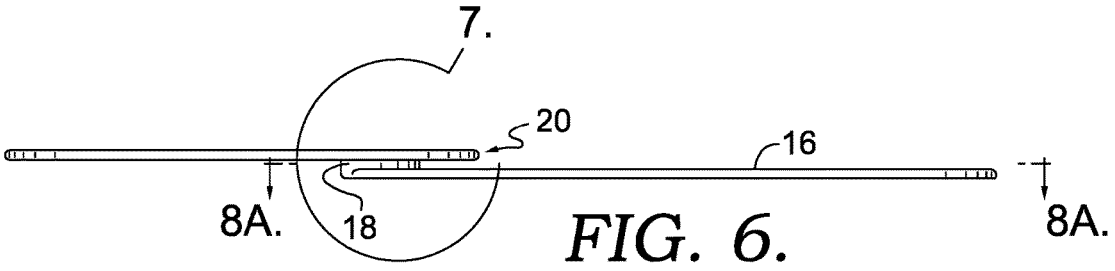
Figure 7:
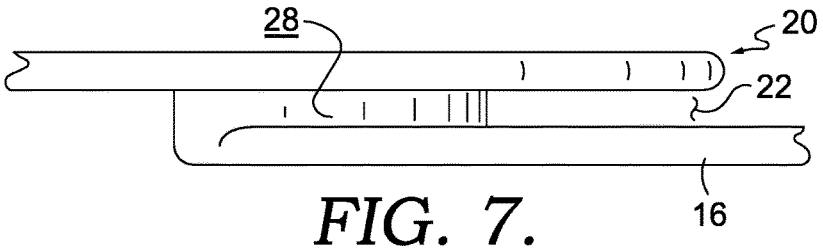
Figure 8A:
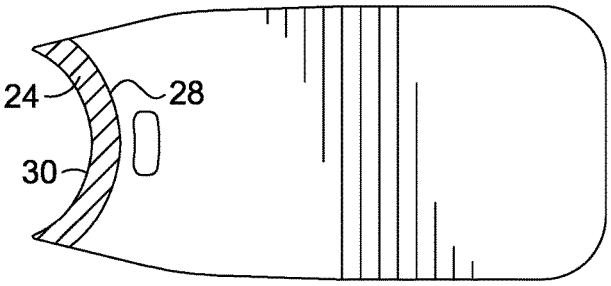
Figure 8B:
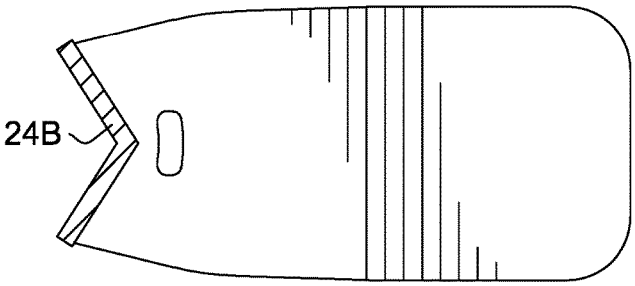
FIG. 8B depicts an alternative hook component in accordance with an aspect hereof.
Figure 9:
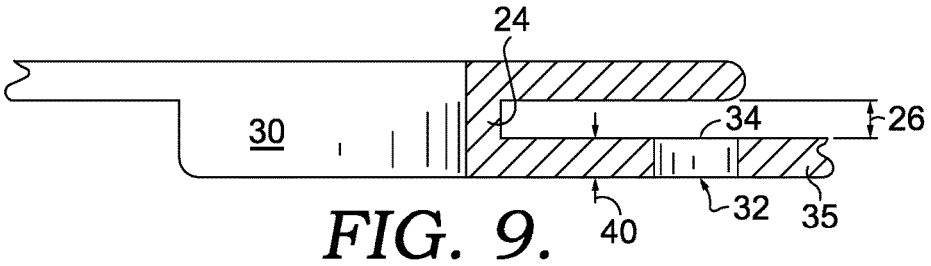

Referring now to FIGS. 4-9, additional features of various hook components are illustratively depicted. FIG. 4 shows a top perspective view of the hook component 12, whereas FIG. 5 shows a bottom view illustrating an underneath side of the hook component 12 (relative to the top depicted in FIG. 4). In addition, FIG. 6 shows a side view, and FIG. 7 shows a magnified side view of a portion of the hook component 12. FIGS. 8A and 9 depict cross-sectional views of portions of the hook component 12, and FIG. 8B depicts an alternative aspect of another hook component.

In one aspect of the disclosure, the hook component 12 includes a hook-component stem 16, a neck 18 extending from the hook-component stem 16, and a cantilevered lip 20 that is coupled to the neck 18 and that overhangs the hook-component stem 16. The neck 18 suspends the cantilevered lip 20 apart from the hook-component stem 16 to form a catch-receiving slot 22 between the cantilevered lip 20 and the hook-component stem 16.

The neck 18 includes various features that may contribute to the functionality of the clasp 10. For example, as indicated above, the neck 18 spaces the cantilevered lip 20 from the hook-component stem 16 in order to create the catch-receiving slot 22. Furthermore, the neck 18 includes a wall 24 (e.g., FIG. 9) having a wall height 26 that at least partially determines a size (e.g., height) of the catch-receiving slot 22. This slot sizing (by way of the wall height 26) is at least one factor that may contribute to a desired fit between the hook-component 12 and a portion of the catch component 14 that is retained in the catch-receiving slot 22 (as will be described in more detail below). For example, the slot sizing of the slot 22 may correspond with a sizing of the catch component in a manner that allows the catch component to slide into the slot and be retained in the slot 22. Furthermore, the slot sizing corresponds with the catch component in a manner to provide a friction fit between the components. In one aspect, the wall height is in a range of about 0.7 mm to about 1.1 mm, which may contribute to a target overall height or thickness of the clasp 10. In a further aspect, the wall height is about 0.8 mm. And in other aspects the wall height 26 may be shorter than 0.7 mm or taller than 1.1 mm.

In a further aspect, wall 24 includes a non-linear wall having as slot-facing surface 28 that curves in a convex manner towards (or into) the catch-receiving slot 22. In addition, the wall 24 may include a concave surface 30 (e.g., FIG. 9) that generally opposes the convex surface 28. The wall 24 may provide a desired amount of rigidity to a corner joint between the curved wall and the cantilevered lip 20 and to a corner joint between the curved wall and the hook-component stem 16. Although a curved wall is depicted, other non-linear walls may be used to construct the neck that might also contribute some rigidity to the hook component. For example, the non-linear wall may be constructed of two or more walls that meet at a wall joint, such as a wall 24B depicted in FIG. 8B, or may include one or more other types of curves. A non-linear wall (e.g., 24 and 24B) may provide more rigidity than if the cantilevered lip 20 and the hook-component stem 16 were connected by a neck having a wall extending linearly across the entire stem and lip without any curvature or change in direction. This type of single-plane linear wall (in contrast to the exemplary non-linear walls 24 and 24B) could provide joints that are more susceptible to folding at the corner joint between the neck and the lip and the neck and the stem.

The hook-component stem 16 also includes various features that may contribute to the functionality of the hook component 12 and the clasp 10. Generally, the hook-component stem 16 includes a top surface 31 and a bottom surface 33 and a thickness extending between the top surface 31 and the bottom surface 33 (e.g., reference numeral 40 in FIG. 9). In this sense, the hook-component stem 16 includes a plate body between the top surface 31 and the bottom surface 33. In addition, the hook-component stem 16 includes terminating side edges 36 and 38 that form perimeter boundaries around at least part of the plate body.

In one aspect of the disclosure, the hook component 12 includes a detent-receiving aperture 32 constructed into the hook-component stem 16. The detent-receiving aperture 32 is depicted as a through-hole that extends entirely through the thickness of the hook-component stem 16 (e.g., through the plate body 35), from the top surface 31 to the bottom surface 33. But in other aspects, the detent-receiving aperture 32 may extend only part way through the thickness into the top surface 31. The detent-receiving aperture 32 includes an aperture collar 34 that forms an aperture profile. That is, the aperture collar 34 is an edge of the hook-component stem 16 that forms a perimeter boundary around the detent-receiving aperture 32.

Figure 13:
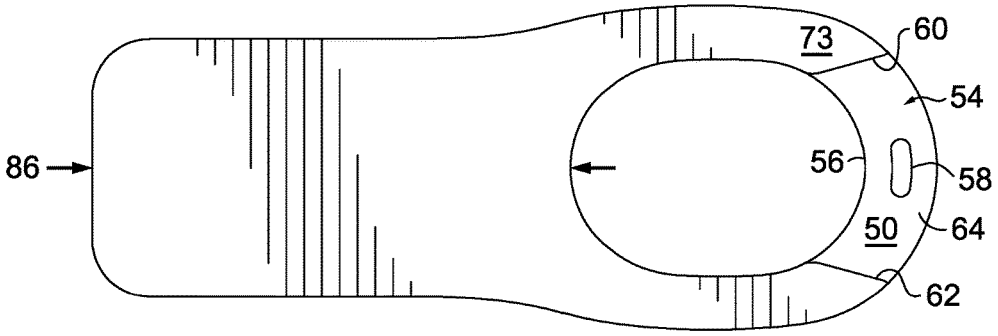
Figure 15:
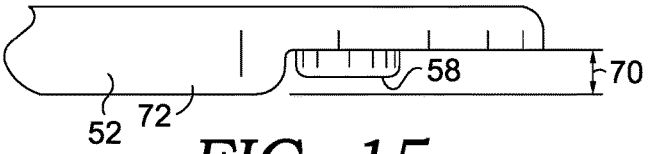

In one aspect, the detent-receiving aperture 32 receives a detent of the catch component 14 (see e.g., detent 58 in FIGS. 13 and 15). Moreover, the aperture profile may correspond with a detent profile to affect the fit of the detent within the aperture. For example, the detent may be a cylindrical or spherical, such that the aperture profile includes a corresponding circular profile that fits the shape of the detent. In a further aspect, the detent profile and the aperture profile may include a non-circular, cross-sectional profile, such that engagement of the detent with the aperture collar impedes rotation of the hook component relative to the catch component. For example, the aperture profile depicted in FIG. 5 is at least partially ovular, elongated, and partially arced. Further, the aperture profile may include a variety of other non-circular configurations that could similarly impede rotation of the detent within the detent-receiving aperture, or rotation of the hook-component stem 16 about the detent.

The hook-component stem 16 includes a first stem outer edge 36 and a second stem outer edge 38 that provide terminating outer edges along sides of the hook-component stem 16. In an aspect of the disclosure, the first stem outer edge 36 and the second stem outer edge 38 form a profile corresponding with a groove of the catch component (see e.g., groove 54 in FIGS. 12 and 13). As such, the hook-component stem 16 nests within the groove when the parts are arranged in interlocking configuration, as illustrated in FIG. 16. In aspects in which the profile formed by the edges 36 and 38 corresponds with a profile of the groove, the hook-component stem 16 and the groove may interlock in a key-and-keyway manner to provide a more complimentary fit. That is, a key-and-keyway relationship includes respective shapes that are complimentary in nature and that fit together in a more congruent manner when the respective parts are positioned or aligned in a particular orientation. This more complimentary fit may contribute to smaller gaps between the interlocking components and to a lower overall profile of the clasp. In addition, the complimentary fit may help to impede rotation of the hook component 12 relative to the catch component 14 as a result of the edges 36 and 38 engaging the side walls of the groove.

In one aspect of the disclosure, the exemplary hook-component stem 16 includes edges 36 and 38 that are non-parallel with respect to one another. For example, the illustrated edges 36 and 38 taper towards one another as the edges extend towards the neck 18. In this sense, the edges 36 and 38 form a tapered keyway profile, which may confer some of the functionality mentioned above (e.g., lower profile and impeded rotation). In addition, the tapered keyway profile can impede longitudinal shifting of the hook component 12 once the hook-component stem 16 is nested in the groove. For instance, the tapered edges can impede shifting in the direction of arrow D in FIG. 16. Although the figures depict the edges 36 and 38 tapering towards one another, various other non-parallel edges and/or non-linear edges, which are complimentary with groove side walls, are contemplated that may afforest similar functionality.

The hook-component stem 16 includes a plate thickness 40 between the top surface 31 and the bottom surface 33, and the plate thickness 40 may contribute to the overall thickness of the clasp 10. For example, the plate thickness 40 may be configured to be similar to a depth of the groove constructed into the catch component 14. As such, when the hook-component stem 16 is nested in the groove, the bottom surface 33 of the hook-component stem 16 is substantially flush with a surface 73 of the catch component 14 (see e.g., FIG. 16). A flush relationship of the underneath side surface 33 with the catch component 14 may contribute to the functionality of the clasp in various ways, such as by reducing the profile of the clasp and by reducing edges along a side of the clasp that might be worn against a wearer's body. In one aspect, the plate thickness 40 is in a range of about 0.7 mm to about 1.1 mm, which may contribute to a target overall height or thickness of the clasp 10. In a further aspect, the plate thickness 40 is about 0.8 mm. And in other aspects the plate thickness 40 may be shorter than 0.7 mm or taller than 1.1 mm.

In the illustrative aspect depicted by FIGS. 4, 5, and 6, the hook component 12 includes a brim 41 that extends in the opposite direction from the cantilevered lip 20. The brim 41 includes an outer rim 43A and an inner rim 43B that form terminating edges on the outer and inner portions of the brim 41, respectively, and the inner rim 43B forms a perimeter around an aperture. In one aspect, the brim 41 may engage at least part of the catch component 14 in the interlocking relationship to help retain the components in place. In addition, the brim 41 may provide a smooth and continuous edge (e.g., the outer rim 43A) on the brim side of the clasp, the smooth and continuous edge reducing edges or corner that may snag on the garment or on the wearer.

Figure 10:
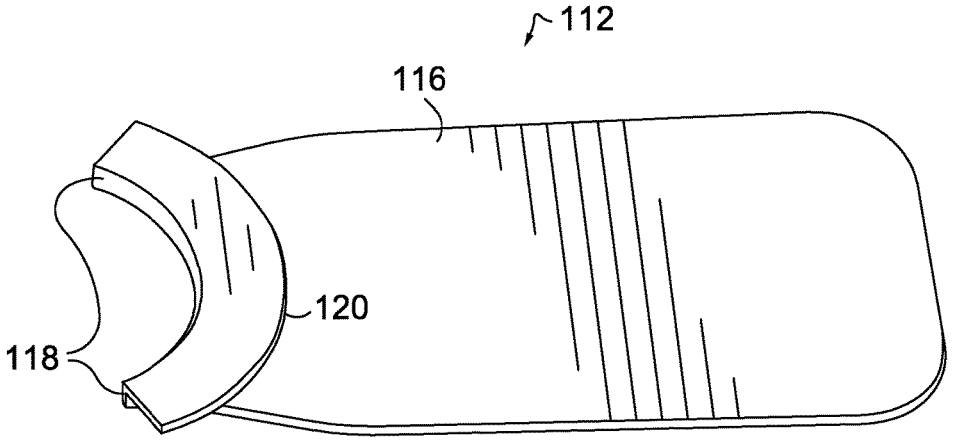
FIGS. 10 and 11 each depicts a different alternative hook component in accordance with an aspect hereof.

In other aspects of the disclosure, the brim 41 may be modified or omitted from the construction. For example, the brim may include a solid disk in which the outer rim 43A forms a perimeter edge and in which the inner rim 43 (and aperture) is omitted. In addition, referring to FIG. 10 an alternative hook component 112 is illustrated. The hook component 112 is similar to the hook component 12. For example, the hook component 112 includes a similar hook-component stem 116, neck 118, and cantilevered lip 120, which function in a manner similar to the hook component 12. In addition, the hook-component stem 116 includes a profile (e.g., tapered edges), and the hook component 112 may include a detent-receiving aperture (not viewable in the perspective provided by FIG. 10). However, the hook component 112 does not include a brim.

Figure 11:
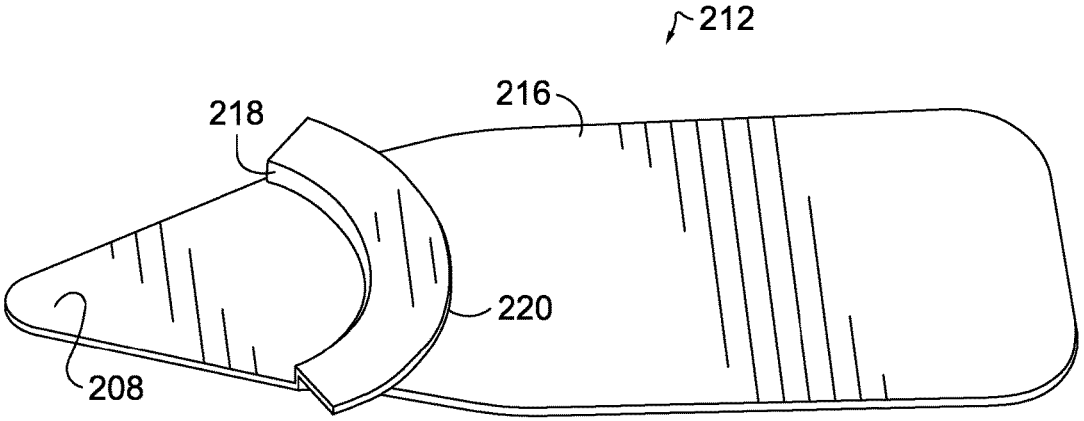

Referring to FIG. 11, another alternative hook component 212 is illustrated. The hook component 212 is similar to the hook component 12 and the hook component 112. For example, the hook component 212 includes a similar hook-component stem 216, neck 218, and cantilevered lip 220, which function in a manner similar to the hook component 12 and the hook component 112. In addition, the hook-component stem 216 includes a profile (e.g., tapered edges), and the hook component 212 may include a detent-receiving aperture (not viewable in the perspective provided by FIG. 11). The hook component 212 does not include a brim, but the hook component 212 does include a tab 208, which may be used to manually manipulate the clasp and/or to support a logo or other labeling information.

Various Exemplary Catch Components

Figure 12:
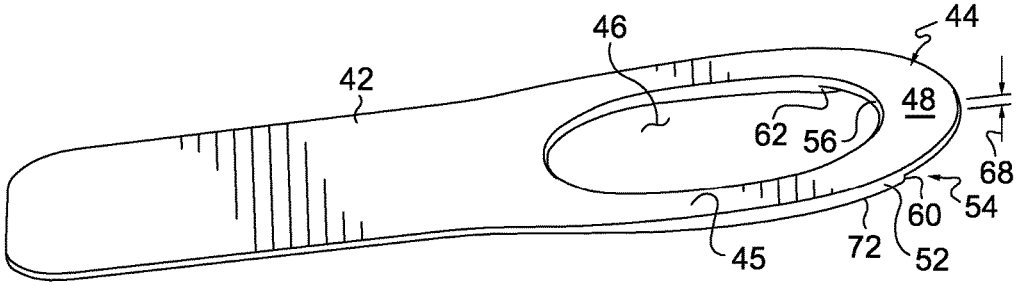
FIGS. 12-15 depict various aspects of a catch component in accordance with an aspect hereof.
Figure 14:
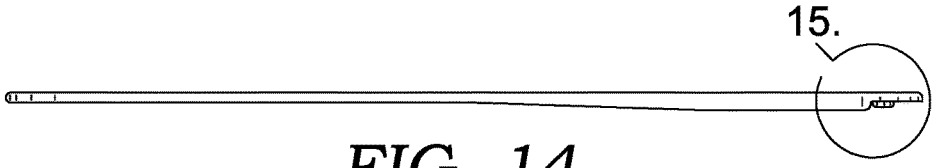

Referring now to FIGS. 12, 13, 14, and 15 additional aspects of the exemplary catch component 14 will be described in more detail. FIG. 12 depicts a top perspective view of the catch component 14, whereas FIG. 13 depicts a bottom view. In addition, FIG. 14 depicts a side view of the catch component 14, and FIG. 15 depicts a magnified view of a portion of the catch component depicted in FIG. 14.

In general, the catch component 14 includes a catch-component stem 42 and a hook-engaging portion 44 coupled to the catch-component stem 42. The catch-component stem 42 is configured to be coupled to an article, and the hook-engaging portion 44 is configured to engage, and interlock with, one or more parts of the hook components 12, 112, and 212. For example, the hook-engaging portion 44 at least partially forms an eyelet 46 through which the cantilevered lip 20, 120, or 220 may pass when connecting and disconnecting the clasp 10. Although the illustrative depictions provided by FIGS. 12 and 13 depict the eyelet 46 as being bound on all sides by a complete, unbroken ring, other eyelet configurations are possible. For example, the hook-engaging portion may only partially extend around the opening of the eyelet, such that a portion of the depicted ring structure is omitted. In that case, the hook component could possibly be inserted through the opening of the eyelet as depicted in FIG. 1, or the hook component could possibly be slid through a slot formed by the omission in the ring structure.

In a further aspect, the hook-engaging portion 44 includes a lip-facing surface 48 that faces towards the cantilevered lip 20, 120, or 220 in the interlocking configuration and a stem-facing surface 50 that faces towards the hook-component stem 16, 116, or 216 in the interlocking configuration. In addition, the hook-engaging portion 44 includes a plate body 52 between the lip-facing surface 48 and the stem-facing surface 50. As described with respect to certain aspects of the hook component 12, the catch component 14 includes a groove 54 constructed into the stem-facing surface 50 and extending into the plate body 52 and towards the lip-facing surface 48. At least a portion of the hook-component stem 16 is nested in the groove 54 in the interlocking configuration (e.g., FIGS. 3 and 16). In addition, the plate body 52 includes a slot-engaging tongue 56 between the groove 54 and the lip-facing surface 48, the slot-engaging tongue 56 being thinner than other portions of the plate body 52 and mating in the catch-receiving slot 22 in the interlocking configuration.

For explanatory purposes, the hook-engaging portion 44 and the plate body 52 may be described to include various segments. For example, one such segment may include the slot-engaging tongue 56. For functionality, at least part of the hook-engaging portion 44 spaces the slot-engaging tongue 56 apart from the catch-component stem 42 in order to form the opening of the eyelet 46, through which the cantilevered lip 20, 120, or 220 may pass. As such, the hook-engaging portion 44 and the plate body 52 may also be described as including one or more "arms" or "extension members" (see e.g., component 45 in FIG. 12).

In another aspect of the disclosure, the catch component 14 further comprises a detent 58 constructed onto (or extending away from) the stem-facing surface 50. As described with respect to the hook component 12, the detent 58 mates in the detent-receiving aperture 32 when the hook-component stem 16 is nested in the groove 54, the slot-engaging tongue 56 is received in the slot 22, and the components are in the interlocking configuration. Among other things, the mating of the detent 58 with the detent-receiving aperture 32 may help to impede the clasp from being unintentionally disconnected. For instance, the mating of the detent 58 in the detent-receiving aperture 32 may impede movement of the hook component 12 in the direction of the arrow D in FIG. 16. Furthermore, as described with respect to the detent-receiving aperture 32, the detent 58 may include a non-circular, cross-sectional profile, such that engagement of the detent 58 with the aperture collar 34 impedes rotation of the hook component relative to the catch component. But a circular or spherical detent may also be included in alternative aspects.

The detent 58 may provide additional functionality. For example, in one aspect when the slot-engaging tongue 56 is being slid into the slot 22, the detent 58 functions to transmit a force against the hook-component stem 16 that may cause one or more portions of the hook component and/or the catch component to elastically deform prior to the detent 58 snapping into the detent-receiving aperture 32. The elastic deformation of the parts may result from one or more characteristics, such as the thicknesses of the various parts of the components that contribute to a low profile nature, the material from which the components are constructed, or a combination thereof. This snapping action contributed to by the detent 58 helps to provide feedback to a person operating the clasp 10 that the clasp is interlocked. For example, the snap of the detent 58 into position may provide audible feedback, tactile feedback, or a combination thereof. This feedback may be helpful in various contexts, such as when the clasp is being blindly operated (e.g., on a bra or other garment behind a person's back).

In a further aspect, the groove 54 includes certain features that contribute to the functionality of the clasp 10. For example, the groove 54 includes first groove side wall 60 and a second groove side wall 62 that form sides of the groove 54. In addition, the first groove side 60 wall and the second groove side 62 wall are connected by a groove base wall 64. As explained with respect to the hook component 12 and the hook-component stem 16, in accordance with an aspect of the disclosure, the first groove side wall 60 and the second groove side wall 62 form a profile that corresponds with, and complements, a portion of the hook-component stem 16. For example, the exemplary figures depict one aspect in which the first side wall 60 and the second side wall 62 taper towards one another to form a tapered keyway profile. As such, the first stem outer edge 36 and the second stem outer edge 38 may taper towards one another as the hook-component stem 16 extends towards the neck 18 to form a tapered key profile, which is complementary with the tapered keyway profile.

The catch component 14 may include other elements or features. For example, the slot-engaging tongue 56 includes a thickness 68 (see FIG. 12) that is configured to mate, and be received in, the slot 22. In one aspect of the disclosure, the thickness 68 is configured to contribute to a desired fit in the catch-receiving slot 22. For example, the thickness 68 may correspond with a slot sizing 26 in a manner that allows the catch component to slide into the slot and be retained in the slot 22. Furthermore, the thickness 68 may correspond with the slot sizing 26 in a manner to provide a frictional engagement between the slot-engaging tongue 56 and the cantilevered lip 20 and the hook-component stem 16 on opposing sides of the slot-engaging tongue 56. For example, in one aspect, the thickness 68 is larger than the dimension 26 by an amount that is in a range of 1% to about 25%. As such, the thicker tongue 56 may be wedged between the lip 20 and the stem 16 in order to frictionally couple the components. And in other aspects, the thickness 68 is substantially similar to the dimension 26, which may result in a lower amount of friction as compared to a thickness 68 that is larger than the dimension 26—but the friction may still be sufficient to contribute to a coupling between the components. In a further aspect, the thickness 68 may be smaller than the dimension 26, in which case the components can still be effectively mated using the engagement of the slot-engaging tongue 56 and the neck 18, the detent 58 and the detent-receiving aperture 32, the hook-component stem 16 and the groove 54, or any combination thereof.

In a further aspect, the groove 54 includes a groove depth 70 (FIG. 15) that is substantially similar to a thickness 40 of the hook-component stem 16. As such, and as described in other parts of the disclosure, the hook-component stem 16 may fit in the groove 54 substantially flush with the other portions 72 of the plate body 52 that are thicker than the slot-engaging tongue 56 when the hook-component stem 16 is nested in the groove in the interlocking configuration. Referring again to FIG. 16, the bottom surface 33 of the hook-component stem is substantially flush with the surface 73 of the thicker portion 72. For example, the groove depth and the thickness of the hook-component stem may both be a range of about 0.7 mm to about 1.1 mm in order to facilitate a clasp having a target overall height. However, a common sized groove depth and stem thickness may be smaller than, or larger than, this range in other aspects of the disclosure.

The term "low profile" may refer to a clasp having a total thickness between an inward facing surface (e.g., surfaces 73 and 33, facing towards the wearer when the clasp is in an as-worn arrangement) and an outward facing surface (e.g., facing away from the wearer when the clasp is in the as-worn arrangement) in a range of about 1.4 mm to about 2.5 mm. However, this range is merely exemplary of one aspect of the disclosure, and in other aspects the overall thickness of clasp may be less than 1.4 mm or greater than 2.5 mm.

The hook component and the catch component may be constructed of various materials by injection molding, casting, rapid-prototype manufacturing, and the like. For example, the hook component and the catch component may be constructed of various polymers or copolymers (such as Nylon, thermoplastic polyurethane, polyethylene, etc.), rubber, composite rubber, and the like. In addition, the material properties of the material may be selected to provide an amount of flexibility, wear resistance, wash resistance, ruggedness, elasticity, durometer and the like. In one aspect, the shore hardness is formulated in a range of about 60D to about 100D (or above 90A). However, in other aspects, the formulation may be softer than these ranges. In a further aspect, the material from with the components are constructed contributes to the ability of the components to interlock, while maintaining a relatively low profile and less rigidity. In addition, the material may contribute to the clasp being more comfortable directly against a wearer's skin, such as in a bra context.

Exemplary Articles

Figure 17:
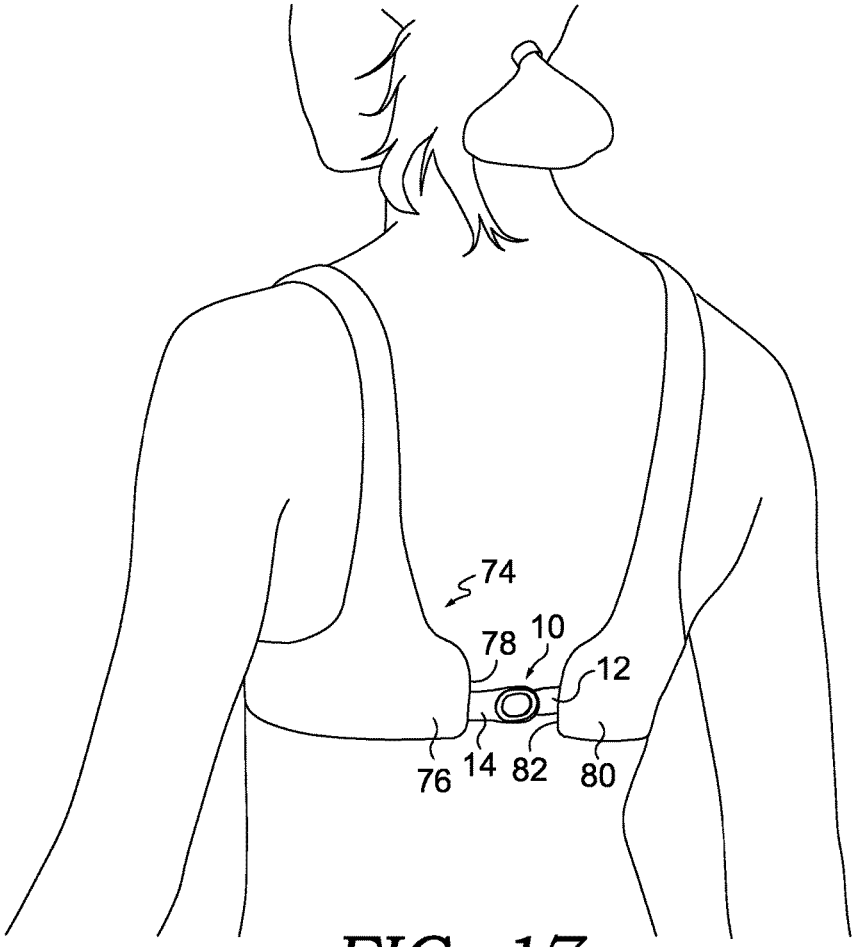
FIG. 17 depicts an article having a clasp in accordance with an aspect hereof.

Referring now to FIG. 17, an article 74 is depicted as a bra. The article 74 includes a first strap 76 with a first-strap terminating end 78, and the first-strap terminating end 78 is coupled to a catch component 14. In addition, the article 74 includes a second strap 80 having as second-strap terminating 82 end coupled to a hook component 12. The catch component 14 releasably mates with the hook component 12 in an interlocking configuration to couple the first strap 76 to the second strap 80.

The straps might be coupled to the stems using various coupling techniques. For example, the straps might be sewn to the stems, bonded to the stems, welded, and the like. In a further aspect, one or more elements of the hook-component stem 16 and the catch-component stem 42 contribute to the functionality of the clasp 10 by providing a handle onto which a person may grasp when operating the clasp to connect or disconnect the components. For example, the hook-component stem 16 may include a length 84 (FIG. 5) that is sufficient to allow a user to grip the hook component 12, and the catch-component stem 42 may include a length 86 (FIG. 13) that is sufficient to allow a user to grip the catch component 14. In one aspect, the lengths 84 and 86 are at least about 45 mm long.

The bra is merely illustrative of one type of bra, and the clasp 10 might be usable with a variety of different types of bras. In addition, the clasp 10 may be usable with various other type of garments and articles, such as belts, waistband constructions, adjustable headwear, footwear, bags, and the like.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

The invention claimed is:

1. A clasp for joining two articles, the clasp comprising:

a hook component that mates with a catch component in an interlocking configuration;

the hook component comprising a hook-component stem configured to be coupled to a first article, a neck extending from the hook-component stem, and a cantilevered lip that is coupled to the neck and that overhangs the hook-component stem, wherein the neck suspends the cantilevered lip apart from the hook-component stem to form a catch-receiving slot between the cantilevered lip and the hook-component stem; and the catch component comprising a catch-component stem configured to be coupled to a second article and a hook-engaging portion coupled to the catch-component stem, the hook-engaging portion at least partially forming an eyelet configured to receive the cantilevered lip when the hook component is mated with the catch component to achieve the interlocking configuration, the hook-engaging portion including a lip-facing surface that faces towards the cantilevered lip in the interlocking configuration and a stem-facing surface that faces towards the hook-component stem in the interlocking configuration;

wherein the hook-engaging portion includes a plate body between the lip-facing surface and the stem-facing surface;

wherein the hook-engaging portion includes a groove constructed into the stem-facing surface and extending into the plate body and towards the lip-facing surface, at least a portion of the hook-component stem being nested in the groove in the interlocking configuration; and wherein the plate body includes a slot-engaging tongue between the groove and the lip-facing surface, the slot-engaging tongue being thinner than other portions of the plate body and mating in the catch-receiving slot in the interlocking configuration.

2. The clasp of claim 1, wherein the hook component further comprises a detent-receiving aperture constructed into the hook-component stem, wherein the catch component further comprises a detent constructed onto the stem-facing surface, and wherein the detent mates in the detent-receiving aperture when the hook-component stem is received in the groove and the components are in the interlocking configuration.

3. The clasp of claim 2, wherein the detent includes a non-circular, cross-sectional profile, and wherein the detent-receiving aperture includes an aperture collar that forms an aperture profile corresponding with the non-circular, cross-sectional profile, such that engagement of the detent with the aperture collar impedes rotation of the hook component relative to the catch component.

4. The clasp of claim 1, wherein the groove includes first groove side wall and a second groove side wall that form sides of the groove, wherein the first groove side wall and the second groove side wall are connected by a groove base wall, and wherein the first groove side wall and the second groove side wall form a keyway profile that corresponds with a portion of the hook-component stem.

5. The clasp of claim 4, wherein the hook-component stem includes a first stem outer edge and a second stem outer edge that provide terminating outer edges along sides of the hook-component stem and that form a key profile corresponding with the keyway profile.

6. The clasp of claim 5, wherein the first side wall and the second side wall taper towards one another to form a tapered keyway profile, and wherein the first stem outer edge and the second stem outer edge taper towards one another as the hook-component stem extends towards the neck to form a tapered key profile complementary with the tapered keyway profile.

7. The clasp of claim 6, wherein the hook component further comprises a detent-receiving aperture constructed into the hook-component stem and between the first stem outer edge and the second stem outer edge, wherein the catch component further comprises a detent constructed onto the grove base wall and between the first and second groove side walls, and wherein the detent mates in the detent-receiving aperture when the hook-component stem is received in the groove and the components are in the interlocking configuration.

8. The clasp of claim 7, wherein the detent includes a non-circular, cross-sectional profile, and wherein the detent-receiving aperture includes an aperture collar that forms an aperture profile corresponding with the non-circular, cross-sectional profile, such that engagement of the detent with the aperture collar impedes rotation of the hook component relative to the catch component.

9. The clasp of claim 1, wherein the catch-receiving slot includes a height measured from the cantilevered lip to the hook-component stem in a range of about 0.8 mm to about 1.0 mm.

10. The clasp of claim 9, wherein the slot-engaging tongue includes a thickness in a range of about 0.8 mm to about 1.0 mm, and wherein the slot-engaging tongue is releasably retained in the catch-receiving slot at least in part by a friction fit created between the slot-engaging tongue and the cantilevered lip and between the slot-engaging tongue and the hook-component stem.

11. The clasp of claim 10, wherein the groove includes a groove depth that is substantially similar to a thickness of the hook-component stem, and wherein the hook-component stem is substantially flush with the other portions of the plate body that are thicker than the slot-engaging tongue when the hook-component stem is nested in the groove in the interlocking configuration.

12. The clasp of claim 11, wherein the groove depth and the thickness of the hook-component stem are in a range of about 0.8 mm to about 1.0 mm.

13. The clasp of claim 11, wherein the other portions of the plate body are in a range of about 1.5 mm to about 2.0 mm.

14. The clasp of claim 11, wherein the groove includes first groove side wall and a second groove side wall that form sides of the groove, and wherein the first groove side wall and the second groove side wall taper towards one another from a groove width of about 22 mm to about 18 mm.

15. The clasp of claim 14, wherein the hook-component stem includes a first stem outer edge and a second stem outer edge that provide terminating outer edges along sides of the hook-component stem and that taper from a stem width of at least about 25 mm to about 17 mm.

16. An article comprising:

a first strap coupled to a hook component;

a second strap coupled to a catch component, wherein the catch component releasably mates with the hook component in an interlocking configuration to couple the first strap to the second strap;

the hook component comprising a hook-component stem coupled to the first strap, a neck extending from the hook-component stem, and a cantilevered lip that is coupled to the neck and that overhangs the hook-component stem, wherein the neck suspends the cantilevered lip apart from the hook-component stem to form a catch-receiving slot between the cantilevered lip and the hook-component stem; and the catch component comprising a catch-component stem, which is coupled to the second strap, and a hook-engaging portion coupled to the catch-component stem, the hook-engaging portion at least partially forming an eyelet configured to receive the cantilevered lip when the hook component is mated with the catch component to achieve the interlocking configuration, the hook-engaging portion including a lip-facing surface that faces towards the cantilevered lip in the interlocking configuration and a stem-facing surface that faces towards the hook-component stem in the interlocking configuration;

wherein the hook-engaging portion includes a plate body between the lip-facing surface and the base-facing surface;

wherein the hook-engaging portion includes a groove constructed into the stem-facing surface and extending into the plate body and towards the lip-facing surface, at least a portion of the hook-component stem being nested in the groove in the interlocking configuration; and wherein the plate body includes a slot-engaging tongue between the groove and the lip-facing surface, the slot-engaging tongue being thinner than other portions of the plate body and mating in the catch-receiving slot in the interlocking configuration.

17. The article of claim 16, wherein the hook-component stem includes a length extending from a hook-component terminating edge to the neck at least about 45 mm long, and wherein the catch-component stem includes a length extending from a catch-component terminating edge to the eyelet at least about 45 mm long.

18. The article of claim 17, wherein the article is a bra and wherein the first and second straps releasably couple a back portion of the bra.

19. A clasp for joining two articles, the clasp comprising:

a hook component that mates with a catch component in an interlocking configuration;

the hook component comprising a hook-component stem configured to be coupled to a first article, a neck extending from the hook-component stem, and a cantilevered lip that is coupled to the neck and that overhangs the hook-component stem;

wherein the neck suspends the cantilevered lip apart from the hook-component stem to form a catch-receiving slot between the cantilevered lip and the hook-component stem; and wherein the neck includes a wall height that at least partially determines a dimension of the catch-receiving slot; and the catch component comprising a catch-component stem configured to be coupled to a second article and a hook-engaging portion coupled to the catch-component stem, the hook-engaging portion at least partially forming an eyelet configured to receive the cantilevered lip when the hook component is mated with the catch component to achieve the interlocking configuration, the hook-engaging portion including a lip-facing surface that faces towards the cantilevered lip in the interlocking configuration and a stem-facing surface that faces towards the hook-component stem in the interlocking configuration;

wherein the hook-engaging portion includes a plate body between the lip-facing surface and the stem-facing surface; and wherein the plate body includes a slot-engaging tongue that mates in the catch-receiving slot in the interlocking configuration and that includes a plate thickness that corresponds with the wall height of the neck.

20. The clasp of claim 19, wherein the wall height and the plate thickness are in a range of about 0.7 mm to about 1.1 mm.

* * * * *